US011721292B2

(12) United States Patent
Shin et al.

(10) Patent No.: US 11,721,292 B2
(45) Date of Patent: Aug. 8, 2023

(54) DISPLAY APPARATUS AND METHOD OF DRIVING THE SAME

(71) Applicant: SAMSUNG DISPLAY CO., LTD., Yongin-si (KR)

(72) Inventors: Yong-Jin Shin, Asan-si (KR); Kyunho Kim, Yongin-si (KR); Joonsuk Baik, Suwon-si (KR); Bongim Park, Hwaseong-si (KR); Ukjae Jang, Gongju-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/207,613

(22) Filed: Mar. 20, 2021

(65) Prior Publication Data

US 2021/0295783 A1 Sep. 23, 2021

(30) Foreign Application Priority Data

Mar. 20, 2020 (KR) ..... 10-2020-0034551

(51) Int. Cl.
*G09G 3/3291* (2016.01)
*G09G 3/3208* (2016.01)
*G09G 3/36* (2006.01)

(52) U.S. Cl.
CPC ..... *G09G 3/3291* (2013.01); *G09G 3/3208* (2013.01); *G09G 3/3648* (2013.01);
(Continued)

(58) Field of Classification Search
CPC ..... G09G 2330/10; G09G 2330/08; G09G 2320/0285; G09G 2320/043; G09G 2320/0626; G09G 2320/0271; G09G 2320/0295; G09G 2320/0242; G09G 2320/0233; G09G 2360/16; G09G 3/2003;
(Continued)

(56) References Cited

U.S. PATENT DOCUMENTS 8,164,604 B2 * 4/2012 Chung ..... G09G 3/3648 345/694
10,013,920 B2 * 7/2018 Oh ..... G09G 3/3291
(Continued)

FOREIGN PATENT DOCUMENTS

KR 10-1264710 5/2013
KR 10-1710574 2/2017

*Primary Examiner* — Dismery Mercedes
(74) *Attorney, Agent, or Firm* — F Chau & Associates, LLC

(57) ABSTRACT

A display apparatus includes a display panel, a driving controller, and a data driver. The display panel is configured to display an image based on input image data. The driving controller is configured to determine whether the input image data include a display quality deteriorating pattern. The driving controller is configured to determine a first compensation value for compensating a first area disposed at a first side of a main area of the display quality deteriorating pattern and a second compensation value for compensating a second area disposed at a second side of the main area opposite to the first side of the main area, according to a position of the main area. The data driver is configured to apply a data voltage to the display panel using the first compensation value and the second compensation value.

20 Claims, 9 Drawing Sheets

(52) U.S. Cl.
CPC ..... *G09G 2320/0209* (2013.01); *G09G 2320/029* (2013.01); *G09G 2320/0271* (2013.01); *G09G 2320/0285* (2013.01); *G09G 2320/045* (2013.01); *G09G 2330/10* (2013.01)

(58) Field of Classification Search
CPC ..... G09G 3/2059; G09G 2320/045; G09G 2320/041; G09G 2320/0209; G09G 2320/029; G09G 3/3291; G09G 3/3648; G09G 3/3233; G09G 2300/0819
See application file for complete search history.

(56) References Cited

U.S. PATENT DOCUMENTS 11,051,033 B2 * 6/2021 Alshin ..... H04N 19/139
2004/0239587 A1 * 12/2004 Murata ..... G09G 3/20 345/58
2008/0238936 A1 * 10/2008 Kim ..... G09G 3/3648 345/618
2008/0309602 A1 * 12/2008 Hwang ..... G09G 3/006 345/98
2013/0241967 A1 * 9/2013 Nishimura ..... G09G 3/3648 345/89
2014/0146097 A1 * 5/2014 Kimura ..... G09G 3/3648 345/690
2015/0042697 A1 * 2/2015 Park ..... G09G 3/2092 345/77
2015/0381913 A1 * 12/2015 Honda ..... H04N 25/704 348/246
2016/0027168 A1 * 1/2016 Ikeda ..... G09G 3/3426 345/593
2016/0203751 A1 * 7/2016 Suginohara ..... G09G 3/2003 345/694
2017/0032730 A1 * 2/2017 Yeon ..... G09G 3/3607
2017/0061897 A1 * 3/2017 Zhang ..... G09G 3/3426
2017/0243562 A1 * 8/2017 Hu ..... G09G 5/10
2018/0336853 A1 * 11/2018 Nakajima ..... G09G 3/3648
2020/0117104 A1 * 4/2020 Hino ..... G06F 30/30
2021/0193057 A1 * 6/2021 Shin ..... G09G 3/3275

* cited by examiner

FIG. 6

| DETERMINING CROSSTALK PATTERN | |
|---|---|
| BX | GTH1 |
| BG | GTH2 |

FIG. 7

| POSITION AND SIZE OF CROSSTALK PATTERN | |
|---|---|
| XSTART | C |
| XWIDTH | A-C |
| YSTART | D |
| YWIDTH | B-D |

FIG. 8

| BGA/BGB \ BX | 0 | 64 | 128 | 196 | 255 |
|---|---|---|---|---|---|
| 0 | 0 | 0 | 0 | 0 | 0 |
| 64 | 64 | 64 | 65XGAIN | 66XGAIN | 68XGAIN |
| 128 | 128 | 128 | 128 | 129XGAIN | 130XGAIN |
| 196 | 196 | 196 | 196 | 196 | 197XGAIN |
| 255 | 255 | 255 | 255 | 255 | 255 |

FIG. 12

| BGA \ BX | 0 | 64 | 128 | 196 | 255 |
|---|---|---|---|---|---|
| 0 | 0 | 0 | 0 | 0 | 0 |
| 64 | 64 | 64 | 65XLGAIN | 66XLGAIN | 68XLGAIN |
| 128 | 128 | 128 | 128 | 129XLGAIN | 130XLGAIN |
| 196 | 196 | 196 | 196 | 196 | 197XLGAIN |
| 255 | 255 | 255 | 255 | 255 | 255 |

FIG. 13

| BGB \ BX | 0 | 64 | 128 | 196 | 255 |
|---|---|---|---|---|---|
| 0 | 0 | 0 | 0 | 0 | 0 |
| 64 | 64 | 64 | 65XRGAIN | 66XRGAIN | 68XRGAIN |
| 128 | 128 | 128 | 128 | 129XRGAIN | 130XRGAIN |
| 196 | 196 | 196 | 196 | 196 | 197XRGAIN |
| 255 | 255 | 255 | 255 | 255 | 255 |

DISPLAY APPARATUS AND METHOD OF DRIVING THE SAME

CROSS-REFERENCE TO RELATED APPLICATION

This application claims priority under 35 U.S.C. § 119 to Korean Patent Application No. 10-2020-0034551, filed on Mar. 20, 2020 in the Korean Intellectual Property Office (KIPO), the disclosure of which is incorporated by reference herein in its entirety.

TECHNICAL FIELD

Exemplary embodiments of the present inventive concept relate to a display apparatus and a method of driving the display apparatus. More particularly, exemplary embodiments of the present inventive concept relate to a display apparatus determining a crosstalk generating pattern and compensating crosstalk, and a method of driving the display apparatus.

DISCUSSION OF RELATED ART

Generally, a display apparatus includes a display panel and a display panel driver. The display panel includes a plurality of gate lines, a plurality of data lines, a plurality of emission lines, and a plurality of pixels. The display panel driver includes a gate driver, a data driver, and a driving controller. The gate driver outputs gate signals to the gate lines. The data driver outputs data voltages to the data lines. The driving controller controls the gate driver, the data driver, and the emission driver. In addition, the display panel driver may further include a power voltage generator applying a power voltage and an initialization voltage to the display panel.

When the display panel displays a specific pattern, a portion of the display panel may represent a luminance less than a target luminance so that crosstalk may be shown to a user.

SUMMARY

According to an exemplary embodiment of the present inventive concept, a display apparatus includes a display panel, a driving controller, and a data driver. The display panel is configured to display an image based on input image data. The driving controller is configured to determine whether the input image data include a display quality deteriorating pattern. The driving controller is configured to determine a first compensation value for compensating a first area disposed at a first side of a main area of the display quality deteriorating pattern and a second compensation value for compensating a second area disposed at a second side of the main area opposite to the first side of the main area, according to a position of the main area. The data driver is configured to apply a data voltage to the display panel using the first compensation value and the second compensation value.

In an exemplary embodiment of the present inventive concept, when a size of the first area is greater than a size of the second area, the first compensation value may be less than the second compensation value.

In an exemplary embodiment of the present inventive concept, initial compensation values corresponding to the first area and the second area may be stored in a lookup table. The first compensation value may be determined by multiplying a first gain, which is determined according to the position of the main area, by the initial compensation value. The second compensation value may be determined by multiplying a second gain, which is determined according to the position of the main area, by the initial compensation value.

In an exemplary embodiment of the present inventive concept, when the main area is disposed closer to a first end of the display panel in the first side than a second end of the display panel in the second side, the first gain may be greater than one and the second gain is less than one.

In an exemplary embodiment of the present inventive concept, a first initial compensation value corresponding to the first area may be stored in a first lookup table. A second initial compensation value corresponding to the second area may be stored in a second lookup table.

In an exemplary embodiment of the present inventive concept, the first compensation value may be determined by multiplying a first gain, which is determined according to the position of the main area, by the first initial compensation value. The second compensation value may be determined by multiplying a second gain, which is determined according to the position of the main area, by the second initial compensation value.

In an exemplary embodiment of the present inventive concept, the driving controller may be configured to store a first threshold grayscale value for determining the main area and a second threshold grayscale value for determining a background area except for the main area.

In an exemplary embodiment of the present inventive concept, when a grayscale value of the main area is greater than the first threshold grayscale value and a grayscale value of the background area is less than the second threshold grayscale value, the driving controller may be configured to determine that the input image data include the display quality deteriorating pattern.

In an exemplary embodiment of the present inventive concept, when a difference between a first grayscale value corresponding to the main area and a second grayscale value corresponding to a background area except for the main area is greater than a threshold grayscale value difference, the driving controller may be configured to determine that the input image data include the display quality deteriorating pattern.

In an exemplary embodiment of the present inventive concept, the driving controller may be configured to determine a horizontal start point of the main area, a horizontal width of the main area, a vertical start point of the main area, and a vertical width of the main area.

In an exemplary embodiment of the present inventive concept, the driving controller may be configured to determine the first compensation value and the second compensation value according to the horizontal width of the main area.

In an exemplary embodiment of the present inventive concept, when the horizontal width of the main area increases, the first compensation value and the second compensation value may increase.

In an exemplary embodiment of the present inventive concept, the first compensation value and the second compensation value may decrease from the vertical start point of the main area of the display quality deteriorating pattern to a vertical end point of the main area.

According to an exemplary embodiment of the inventive concept, a method of driving a display apparatus includes determining whether input image data include a display quality deteriorating pattern, determining a first compensation value for compensating a first area disposed at a first side of a main area of the display quality deteriorating pattern and a second compensation value for compensating a second area disposed at a second side of the main area opposite to the first side of the main area, according to a position of the main area, and applying a data voltage to a display panel using the first compensation value and the second compensation value.

In an exemplary embodiment of the present inventive concept, when a size of the first area is greater than a size of the second area, the first compensation value may be less than the second compensation value.

In an exemplary embodiment of the present inventive concept, initial compensation values corresponding to the first area and the second area may be stored in a lookup table. The first compensation value may be determined by multiplying a first gain, which is determined according to the position of the main area, by the initial compensation value. The second compensation value may be determined by multiplying a second gain, which is determined according to the position of the main area, by the initial compensation value.

In an exemplary embodiment of the present inventive concept, when the main area is disposed closer to a first end of the display panel in the first side than a second end of the display panel in the second side, the first gain may be greater than one and the second gain may be less than one.

In an exemplary embodiment of the present inventive concept, the display quality deteriorating pattern may be determined using a first threshold grayscale value for determining the main area and a second threshold grayscale value for determining a background area except for the main area.

In an exemplary embodiment of the present inventive concept, when a grayscale value of the main area is greater than the first threshold grayscale value and a grayscale value of the background area is less than the second threshold grayscale value, the input image data may be determined to include the display quality deteriorating pattern.

In an exemplary embodiment of the present inventive concept, the method may further include determining a horizontal start point of the main area, a horizontal width of the main area, a vertical start point of the main area, and a vertical width of the main area.

According to an exemplary embodiment of the present inventive concept, a method of driving a display apparatus includes determining that input image data includes a display quality deteriorating pattern including a main area and a background area except for the main area, using a first threshold grayscale value for determining the main area and a second threshold grayscale value for determining the background area, determining a horizontal start point of the main area and a horizontal width of the main area, determining a first compensation value for compensating a first area disposed at a first side of the main area and a second compensation value for compensating a second area disposed at a second side of the main area opposite to the first side of the main area, according to the horizontal start point of the main area and the horizontal width of the main area, and applying a data voltage to a display panel using the first compensation value and the second compensation value. When the horizontal width of the main area increases, the first compensation value and the second compensation value increase. Sizes of the first area and the second area are determined using the horizontal start point of the main area. When the size of the first area decreases, the size of the second area increases, and when the size of the first area increases, the size of the second area decreases. When the size of the first area is less than the size of the second area, the first compensation value is greater than the second compensation value. When the size of the first area is greater than the size of the second area, the first compensation value is less than the second compensation value.

BRIEF DESCRIPTION OF THE DRAWINGS

The above and other features of the present inventive concept will become more apparent by describing in detail exemplary embodiments thereof with reference to the accompanying drawings.

FIG. 6 is a conceptual diagram illustrating a first threshold grayscale value and a second threshold grayscale value stored in a driving controller of FIG. 1 to determine the display quality deteriorating pattern according to an exemplary embodiment of the present inventive concept.

FIG. 7 is a conceptual diagram illustrating a method of determining a horizontal start point of a main area of the display quality deteriorating pattern, a horizontal width of the main area, a vertical start point of the main area, and a vertical width of the main area by the driving controller of FIG. 1 according to an exemplary embodiment of the present inventive concept.

FIG. 8 is a conceptual diagram illustrating a method of determining a first compensation value and a second compensation value by the driving controller of FIG. 1 according to an exemplary embodiment of the present inventive concept.

FIGS. 12 and 13 are conceptual diagrams illustrating a method of determining a first compensation value and a second compensation value by a driving controller of a display apparatus according to an exemplary embodiment of the present inventive concept.

DETAILED DESCRIPTION OF THE EMBODIMENTS

Figure 1:
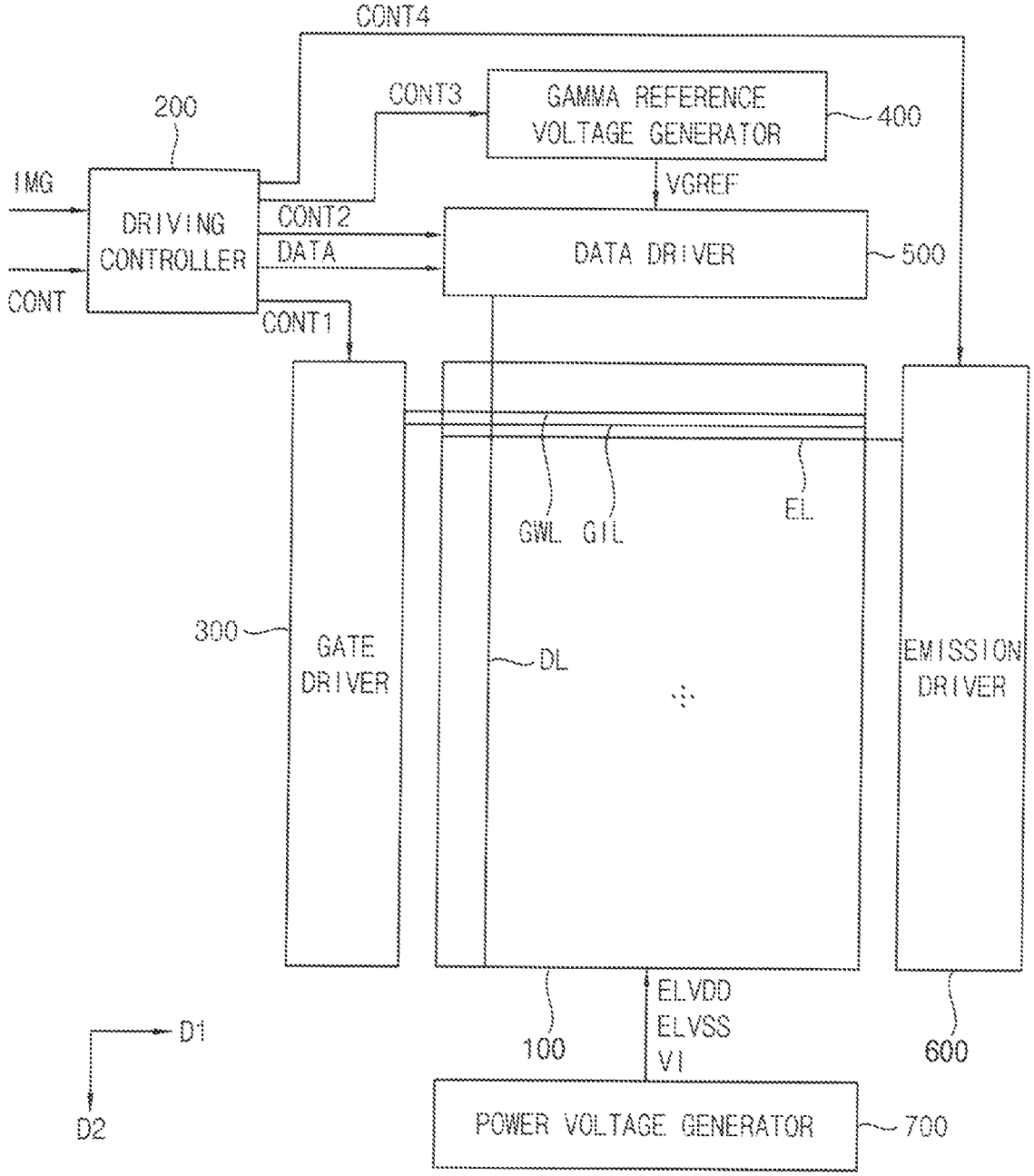
FIG. 1 is a block diagram illustrating a display apparatus according to an exemplary embodiment of the present inventive concept.

Exemplary embodiments of the present inventive concept provide a display apparatus determining a crosstalk generating pattern and compensating crosstalk.

Exemplary embodiments of the present inventive concept also provide a method of driving the display apparatus.

Hereinafter, exemplary embodiments of the present inventive concept will be explained in detail with reference to the accompanying drawings. Like reference numerals may refer to like elements throughout this application.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400, and a data driver 500. The display panel driver may further include an emission driver 600. The display panel driver may further include a power voltage generator 700.

For example, the driving controller 200 and the data driver 500 may be integrally formed. For example, the driving controller 200, the data driver 500, and the power voltage generator 700 may be integrally formed. For example, the driving controller 200, the gamma reference voltage generator 400, and the data driver 500 may be integrally formed. For example, the driving controller 200, the gate driver 300, the gamma reference voltage generator 400, and the data driver 500 may be integrally formed. For example, the driving controller 200, the gate driver 300, the gamma reference voltage generator 400, the data driver 500, and the emission driver 600 may be integrally formed. For example, the driving controller 200, the gate driver 300, the gamma reference voltage generator 400, the data driver 500, the emission driver 600, and the power voltage generator 700 may be integrally formed.

For example, the display panel 100 may be an organic light emitting display panel including an organic light emitting element. Alternatively, the display panel 100 may be a liquid crystal display panel including a liquid crystal layer. The present inventive concept may not be limited to one of the organic light emitting display panel and the liquid crystal display panel. The present inventive concept may be applied to both the organic light emitting display panel and the liquid crystal display panel.

The display panel 100 includes a plurality of gate lines GWL and GIL, a plurality of data lines DL, and a plurality of pixels electrically connected to the gate lines GWL and GIL and the data lines DL. The gate lines GWL and GIL may extend in a first direction D1, the data lines DL may extend in a second direction D2 crossing the first direction D1. The display panel 100 may further include a plurality of emission lines EL extending in the first direction D1 and electrically connected to the pixels.

The driving controller 200 receives input image data IMG and an input control signal CONT from an external apparatus. For example, the input image data IMG may include red image data, green image data, and blue image data. The input image data IMG may include white image data. The input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals to drive the gate lines GWL and GIL in response to the first control signal CONT1 received from the driving controller 200. The gate driver 300 may sequentially output the gate signals to the gate lines GWL and GIL. For example, the gate driver 300 may be mounted on the display panel 100. For example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment of the present inventive concept, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The power voltage generator 700 may generate a power voltage for operating the display panel 100 and the display panel driver. For example, the power voltage generator 700 may output a high power voltage ELVDD to a pixel circuit of the display panel 100. For example, the power voltage generator 700 may output a low power voltage ELVSS to the pixel circuit of the display panel 100. For example, the power voltage generator 700 may output an initialization voltage VI to the pixel circuit of the display panel 100.

Figure 2:
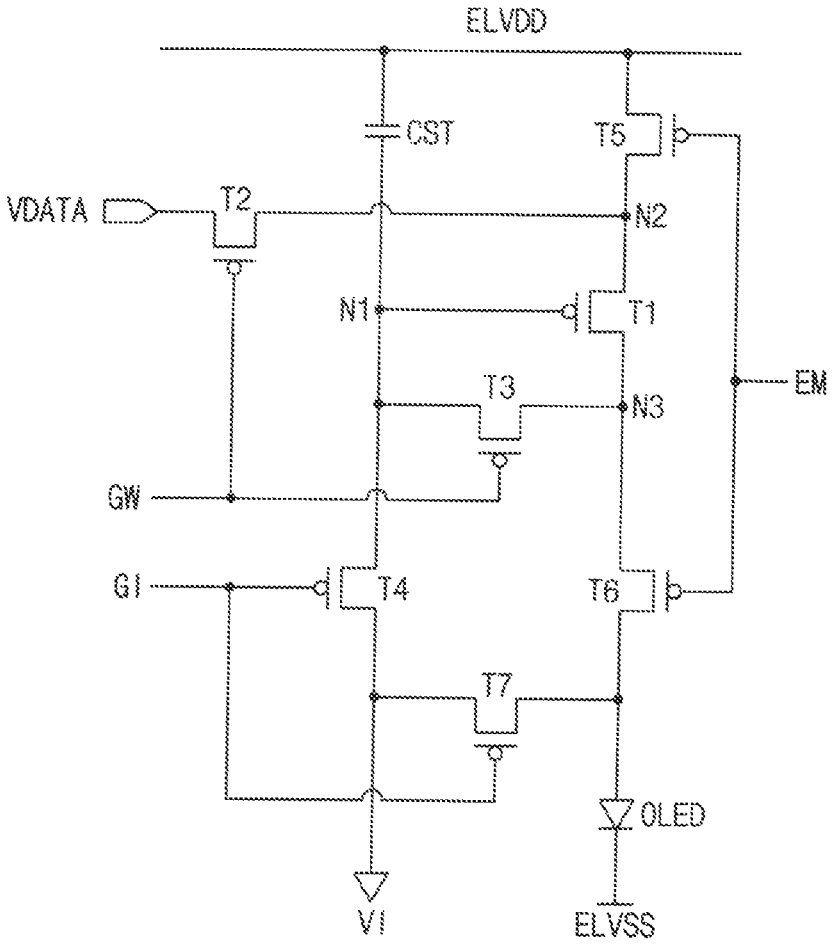
FIG. 2 is a circuit diagram illustrating a pixel of a display panel of FIG. 1 according to an exemplary embodiment of the present inventive concept.

FIG. 2 is a circuit diagram illustrating a pixel of a display panel of FIG. 1 according to an exemplary embodiment of the present inventive concept.

Referring to FIGS. 1 and 2, the display panel 100 includes the plurality of the pixels. Each pixel may include an organic light emitting element OLED. However, the present inventive concept may not be limited to the organic light emitting display panel including the organic light emitting element OLED.

For example, the pixels receive a data write gate signal GW, a data initialization gate signal GI, an organic light emitting element initialization signal, a data voltage VDATA, and an emission signal EM, and the organic light emitting elements OLED of the pixels emit light corresponding to the level of the data voltage VDATA to display the image. In an exemplary embodiment of the present inventive concept, the organic light emitting element initialization signal may be same as the data initialization gate signal GI.

At least one of the pixels may include first to seventh pixel switching elements T1 to T7, a storage capacitor CST, and the organic light emitting element OLED.

Although the pixel includes seven pixel switching elements in the present exemplary embodiment, the present inventive concept may not be limited thereto.

The first pixel switching element T1 includes a control electrode connected to a first node N1, an input electrode connected to a second node N2, and an output electrode connected to a third node N3.

For example, the first pixel switching element T1 may be a P-type thin film transistor. The control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the data write gate signal GW is applied, an input electrode to which the data voltage VDATA is applied, and an output electrode connected to the second node N2.

For example, the second pixel switching element T2 may be a P-type thin film transistor. The control electrode of the second pixel switching element T2 may be a gate electrode, the input electrode of the second pixel switching element T2 may be a source electrode, and the output electrode of the second pixel switching element T2 may be a drain electrode.

The third pixel switching element T3 includes a control electrode to which the data write gate signal GW is applied, an input electrode connected to the first node N1, and an output electrode connected to the third node N3.

For example, the third pixel switching element T3 may be a P-type thin film transistor. The control electrode of the third pixel switching element T3 may be a gate electrode, the input electrode of the third pixel switching element T3 may be a source electrode, and the output electrode of the third pixel switching element T3 may be a drain electrode.

The fourth pixel switching element T4 includes a control electrode to which the data initialization gate signal GI is applied, an input electrode to which an initialization voltage VI is applied, and an output electrode connected to the first node N1.

For example, the fourth pixel switching element T4 may be a P-type thin film transistor. The control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which the high power voltage ELVDD is applied, and an output electrode connected to the second node N2.

For example, the fifth pixel switching element T5 may be a P-type thin film transistor. The control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, and an output electrode connected to an anode electrode of the organic light emitting element OLED.

For example, the sixth pixel switching element T6 may be a P-type thin film transistor. The control electrode of the sixth pixel switching element T6 may be a gate electrode, the input electrode of the sixth pixel switching element T6 may be a source electrode, and the output electrode of the sixth pixel switching element T6 may be a drain electrode.

The seventh pixel switching element T7 includes a control electrode to which the organic light emitting element initialization gate signal GI is applied, an input electrode to which the initialization voltage VI is applied, and an output electrode connected to the anode electrode of the organic light emitting element OLED.

For example, the seventh pixel switching element T7 may be a P-type thin film transistor. The control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode and a cathode electrode to which the low power voltage ELVSS is applied. For example, the organic light emitting element OLED may be an organic light emitting diode.

Figure 3:
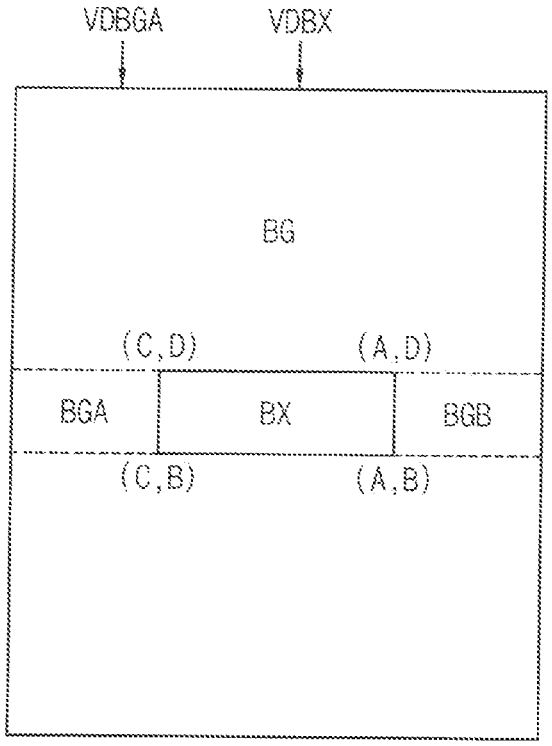
FIG. 3 is a concept diagram illustrating a display quality deteriorating pattern displayed on the display panel of FIG. 1 according to an exemplary embodiment of the present inventive concept.
Figure 4:
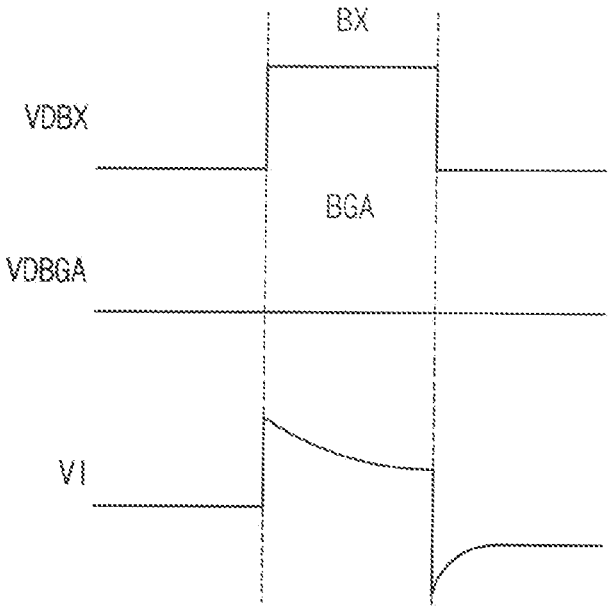
FIG. 4 is a timing diagram illustrating an example level of an initialization voltage according to the display quality deteriorating pattern of FIG. 3 according to an exemplary embodiment of the present inventive concept.
Figure 5:
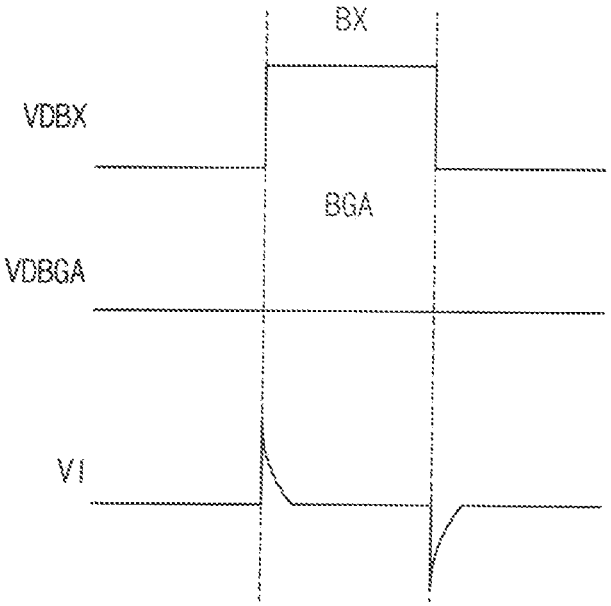
FIG. 5 is a timing diagram illustrating an example level of the initialization voltage according to the display quality deteriorating pattern of FIG. 3 according to an exemplary embodiment of the present inventive concept.

FIG. 3 is a concept diagram illustrating a display quality deteriorating pattern displayed on the display panel of FIG. 1 according to an exemplary embodiment of the present inventive concept. FIG. 4 is a timing diagram illustrating an example level of an initialization voltage according to the display quality deteriorating pattern of FIG. 3 according to an exemplary embodiment of the present inventive concept. FIG. 5 is a timing diagram illustrating an example level of the initialization voltage according to the display quality deteriorating pattern of FIG. 3 according to an exemplary embodiment of the present inventive concept.

Referring to FIGS. 1 to 5, the display quality deteriorating pattern may be a crosstalk pattern generating a crosstalk. The display quality deteriorating pattern may include a main area BX and a background area BG except for (e.g., excluding) the main area BX. The main area BX may have a relatively high luminance. The background area BG may have a relatively low luminance. For example, the main area BX may have a rectangular box shape.

The background area BG disposed at a first side of the main area BX in a horizontal direction may be referred to as a first area BGA. The background area BG disposed at a second side of the main area BX in the horizontal direction opposite to the first side may be referred to as a second area BGB.

When a data voltage applied to the main area BX is VDBX and a data voltage applied to the first area BGA is VDBGA, VDBX may have a relatively high voltage corresponding to the main area BX and may have a relatively low voltage corresponding to the background area BG In contrast, a voltage path of VDBGA does not pass through the main area BX so that VDBGA may continuously have a relatively low voltage.

When VDBX rises from a low level to a high level, voltages in the display panel 100 may increase due to a coupling in the display panel 100. For example, as shown in FIG. 4, when VDBX rises from the low level to the high level, the initialization voltage VI applied to the pixel may increase due to the coupling in the display panel 100. Alternatively, levels of power voltages ELVDD and ELVSS may vary according to VDBX, which may result in deterioration of display quality.

As shown in FIG. 4, when VDBX rises from the low level to the high level, the initialization voltage VI may increase. When the initialization voltage VI increases in response to the rising of VDBX, a difference between a level of the data voltage VDBGA of the first area BGA and a level of the initialization voltage VI decreases so that a luminance of the first area BGA may be lower than a target luminance.

In a similar manner, when the initialization voltage VI increases in response to the rising of VDBX, a difference between a level of the data voltage VDBGB of the second area BGB and the level of the initialization voltage VI decreases so that a luminance of the second area BGB may be lower than the target luminance.

In FIG. 4, for example, the increased initialization voltage VI may be gradually decreased for a relatively long duration so that the decrease of the luminance of the first area BGA and the second area BGB may maintain for the relatively long duration, thus the decrease of the luminance of the first area BGA and the second area BGB may be shown as a plane type.

In FIG. 5, for example, the level of the initialization voltage VI may instantly increase and instantly decrease so that the decrease of the luminance of the first area BGA and the second area BGB may be shown for a short moment, thus the decrease of the luminance of the first area BGA and the second area BGB may be shown as a line type.

Figure 9:
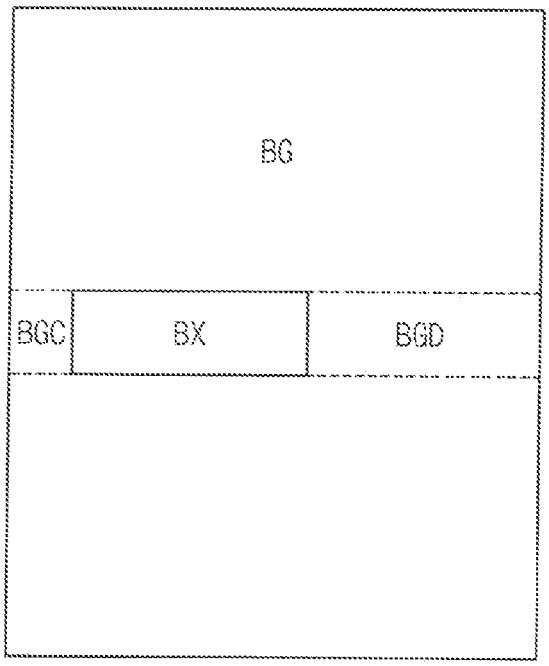
FIG. 9 is a concept diagram illustrating a display quality deteriorating pattern displayed on the display panel of FIG. 1 according to an exemplary embodiment of the present inventive concept.
Figure 10:
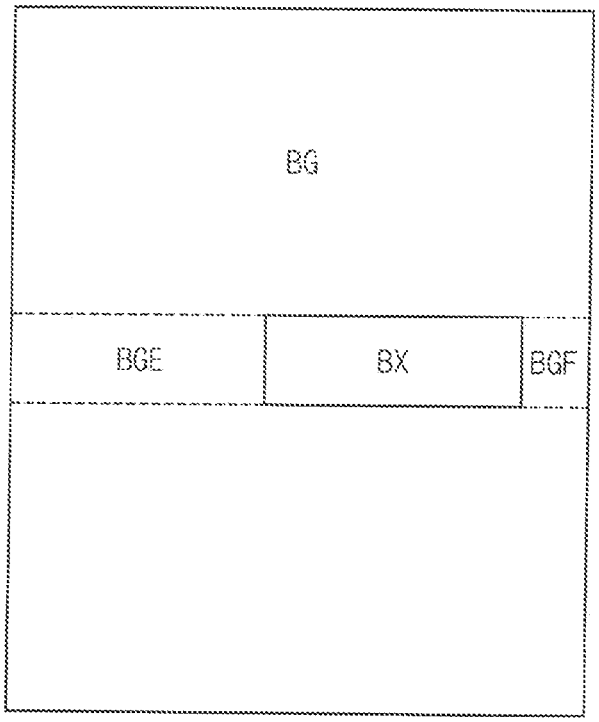
FIG. 10 is a concept diagram illustrating a display quality deteriorating pattern displayed on the display panel of FIG. 1 according to an exemplary embodiment of the present inventive concept.

FIG. 6 is a conceptual diagram illustrating a first threshold grayscale value and a second threshold grayscale value stored in a driving controller of FIG. 1 to determine the display quality deteriorating pattern according to an exemplary embodiment of the present inventive concept. FIG. 7 is a conceptual diagram illustrating a method of determining a horizontal start point of the main area of the display quality deteriorating pattern, a horizontal width of the main area, a vertical start point of the main area, and a vertical width of the main area by the driving controller of FIG. 1 according to an exemplary embodiment of the present inventive concept. FIG. 8 is a conceptual diagram illustrating a method of determining a first compensation value and a second compensation value by the driving controller of FIG. 1 according to an exemplary embodiment of the present inventive concept. FIG. 9 is a concept diagram illustrating a display quality deteriorating pattern displayed on the display panel of FIG. 1 according to an exemplary embodiment of the present inventive concept. FIG. 10 is a concept diagram illustrating a display quality deteriorating pattern displayed on the display panel of FIG. 1 according to an exemplary embodiment of the present inventive concept.

Referring to FIGS. 1 to 10, the driving controller 200 may determine whether the input image data IMG include the display quality deteriorating pattern.

For example, the driving controller 200 may store a first threshold grayscale value GTH1 for determining the main area BX and a second threshold grayscale value GTH2 for determining the background area BG except for the main area BX.

For example, when a grayscale value of the main area BX is greater than the first threshold grayscale value GTH1 and a grayscale value of the background area BG is less than the second threshold grayscale value GTH2, the driving controller 200 may determine that the input image data IMG include the display quality deteriorating pattern.

Alternatively, when a difference between a first grayscale value corresponding to the main area BX and a second grayscale value corresponding to the background area BG except for the main area BX is greater than a threshold grayscale value difference, the driving controller 200 may determine that the input image data IMG include the display quality deteriorating pattern. In the present exemplary embodiment, the driving controller 200 may store the threshold grayscale value difference.

When the input image data IMG include the display quality deteriorating pattern, the driving controller 200 may determine a horizontal start point XSTART of the main area BX, a horizontal width XWIDTH of the main area BX, a vertical start point YSTART of the main area BX, and a vertical width YWIDTH of the main area BX.

In FIG. 3, coordinates of four vertices of the main area BX may be respectively (C, D), (A, D), (C, B), and (A, B). The horizontal start point XSTART of the main area BX may be C. The horizontal width XWIDTH of the main area BX may be A-C. The vertical start point YSTART of the main area BX may be D. The vertical width YWIDTH of the main area BX may be B-D.

The driving controller 200 may determine a first compensation value compensating the first area BGA disposed at or in the first side of the main area BX and a second compensation value compensating the second area BGB disposed at or in the second side of the main area BX according to the position of the main area BX of the display quality deteriorating pattern. For example, sizes of the first area BGA and the second area BGB may be determined using the horizontal start point XSTART of the main area BX, e.g., by determining a distance between sides of the display panel 100 and the horizontal start point XSTART.

For example, when the main area BX is disposed in a central portion of the display panel 100 in the horizontal direction as shown in FIG. 3, the first compensation value corresponding to the first area BGA may be same as the second compensation value corresponding to the second area BGB.

When the main area BX is disposed closer to a first side or end of the display panel 100 in the horizontal direction as shown in FIG. 9, a size of a first area BGC may be less than a size of a second area BGD. When the size of the first area BGC relatively decreases, a degree of coupling in the first area BGC may increase. Thus, when the size of the first area BGC relatively decreases, the first compensation value may increase. When the size of the first area BGC is less than the size of the second area BGD, the first compensation value may be greater than the second compensation value.

When the main area BX is disposed closer to a second side or end of the display panel 100 in the horizontal direction as shown in FIG. 10, a size of a first area BGE may be greater than a size of a second area BGF. When the size of the first area BGE relatively increases, a degree of coupling in the first area BGE may decrease. Thus, when the size of the first area BGE relatively increases, the first compensation value may decrease. When the size of the first area BGE is greater than the size of the second area BGF, the first compensation value may be less than the second compensation value.

Sizes of the first area (e.g., BGA, BGC, BGE) and the second area (e.g., BGB, BGD, BGF) may have an inverse relationship. In other words, when the size of the first area decreases, the size of the second area increases, and when the size of the first area increases, the size of the second area decreases.

Referring back to FIG. 8, initial compensation values corresponding to the first area BGA and the second area BGB may be stored in a lookup table.

For example, when the grayscale value of the background area BG is 64 and the grayscale value of the main area BX is zero or 64, the driving controller 200 may not perceive the display quality deteriorating pattern.

When the grayscale value of the background area BG is 64 and the grayscale value of the main area BX is 128, the driving controller 200 may perceive the display quality deteriorating pattern and the driving controller 200 may adjust the grayscale value of the first area BGA and the second area BGB of the background area BG to 65, which is greater than 64.

When the grayscale value of the background area BG is 64 and the grayscale value of the main area BX is 196, the driving controller 200 may perceive the display quality deteriorating pattern and the driving controller 200 may adjust the grayscale value of the first area BGA and the second area BGB of the background area BG to 66, which is greater than 64.

When the grayscale value of the background area BG is 64 and the grayscale value of the main area BX is 255, the driving controller 200 may perceive the display quality deteriorating pattern and the driving controller 200 may adjust the grayscale value of the first area BGA and the second area BGB of the background area BG to 68, which is greater than 64.

The initial compensation values for the grayscale values not shown in FIG. 8 may be generated using a linear interpolation method.

The first compensation value and the second compensation value may be determined by multiplying a gain by the initial compensation values stored in the lookup table in FIG. 8.

For example, the first compensation value corresponding to the first area BGA may be determined by multiplying a first gain, determined according to the position of the main area BX, by the initial compensation value.

For example, the second compensation value corresponding to the second area BGB may be determined by multiplying a second gain, determined according to the position of the main area BX, by the initial compensation value.

When the main area BX is disposed closer to the first side of the display panel 100 (e.g., when a size of the first area BGA is smaller than a size of the second area BGB), the first gain may be greater than 1 and the second gain may be less than 1. In other words, the first side of the display panel 100 may be adjacent to the first side of the main area BX and the second side of the display panel 100 may be adjacent to the second side of the main area BX. When a distance between the first side of the display panel 100 and the first side of the main area BX is less than a distance between the second side of the display panel 100 and the second side of the main area BX, the size of the first area BGA is smaller than the size of the second area BGB. In contrast, when the main area BX is disposed closer to the second side of the display panel 100 (e.g., when the size of the first area BGA is larger than the size of the second area BGB), the second gain may be greater than 1 and the first gain may be less than 1.

The data driver 500 may apply the data voltage (e.g., VDATA) to the display panel 100 using the first compensation value and the second compensation value.

Figure 11:
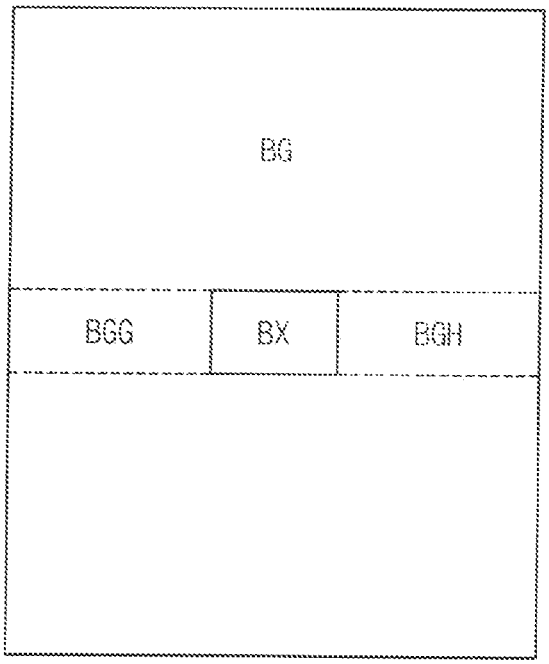
FIG. 11 is a concept diagram illustrating a display quality deteriorating pattern displayed on the display panel of FIG. 1 according to an exemplary embodiment of the present inventive concept.

FIG. 11 is a concept diagram illustrating a display quality deteriorating pattern displayed on the display panel of FIG. 1 according to an exemplary embodiment of the present inventive concept.

The driving controller 200 may determine the first compensation value and the second compensation value according to the horizontal width of the main area BX of the display quality deteriorating pattern.

When the horizontal width of the main area BX increases, the first compensation value and the second compensation value may increase.

The horizontal width of the main area BX in FIG. 11 may be less than the horizontal width of the main area BX in FIG. 3. In addition, a horizontal width of a first area BGG in FIG. 11 may be greater than a horizontal width of the first area BGA in FIG. 3 and a horizontal width of a second area BGH in FIG. 11 may be greater than a horizontal width of the second area BGB in FIG. 3.

The first compensation value and the second compensation value in FIG. 11 may be less than the first compensation value and the second compensation value in FIG. 3. When the horizontal width of the main area BX is relatively small, the degree of change of the initialization voltage VI may be relatively small so that the degree of crosstalk may be decreased, as explained with reference to to FIGS. 4 and 5.

In the above example, for convenience of explanation, the decrease of the luminance of the first area BGA and the second area BGB having a plane type is exemplified. As explained with reference to FIG. 5, the decrease of the luminance of the first area B GA and the second area BGB may have a line type. When the decrease of the luminance of the first area BGA and the second area BGB has a line type, the first compensation value and the second compensation value may be set to decrease from the vertical start point of the main area BX of the display quality deteriorating pattern to a vertical end point of the main area BX. Alternatively, when the decrease of the luminance of the first area BGA and the second area BGB has a line type, the first compensation value and the second compensation value may be set corresponding only to the vertical start point of the main area BX of the display quality deteriorating pattern.

According to the present exemplary embodiment, the driving controller 200 may determine whether the input image data IMG include a display quality deteriorating pattern such as a crosstalk pattern. The driving controller 200 may adjust the first compensation value applied to the left portion of the main area BX of the display quality deteriorating pattern and the second compensation value applied to the right portion of the main area BX, according to a position of the main area BX. Thus, the display quality deterioration may be minimized although the position of the main area BX of the display quality deteriorating pattern varies.

In addition, the driving controller 200 may adjust the first compensation value applied to the left portion of the main area BX of the display quality deteriorating pattern and the second compensation value applied to the right portion of the main area BX, according to a width of the main area BX. Thus, the display quality deterioration may be minimized although the width of the main area BX of the display quality deteriorating pattern varies.

Thus, the display quality deterioration such as the crosstalk may be prevented so that the display quality of the display panel 100 may be enhanced.

FIGS. 12 and 13 are conceptual diagrams illustrating a method of determining a first compensation value and a second compensation value by a driving controller of a display apparatus according to an exemplary embodiment of the present inventive concept.

The display apparatus and the method of driving the display apparatus according to the present exemplary embodiment is substantially the same as the display apparatus and the method of driving the display apparatus of the exemplary embodiments explained with reference to FIGS. 1 to 11, except that the driving controller includes two lookup tables. Thus, the same reference numerals will be used to refer to the same or like parts as those described in the previous exemplary embodiments of FIGS. 1 to 11, and any repetitive explanations concerning the above elements will be omitted.

Referring to FIGS. 1, 3, 12, and 13, the display apparatus includes the display panel 100 and the display panel driver. The display panel driver includes the driving controller 200, the gate driver 300, the gamma reference voltage generator 400, and the data driver 500. The display panel driver may further include the emission driver 600. The display panel driver may further include the power voltage generator 700.

The driving controller 200 may determine whether the input image data IMG include the display quality deteriorating pattern.

The driving controller 200 may determine the first compensation value compensating the first area BGA disposed at the first side of the main area BX and the second compensation value compensating the second area BGB disposed at the second side of the main area BX, according to the position of the main area BX of the display quality deteriorating pattern.

In the present exemplary embodiment, a first initial compensation value corresponding to the first area BGA may be stored in a first lookup table (in FIG. 12). A second initial compensation value corresponding to the second area BGB may be stored in a second lookup table (in FIG. 13).

When the first side and the second side of the display panel 100 have different characteristics according to a structure of the display panel 100 or a driving method of the display panel 100, the driving controller 200 may include the first lookup table for the first side of the display panel 100 and the second lookup table for the second side of the display panel 100.

The first compensation value may be determined by multiplying a first gain LGAIN, which is determined according to the position of the main area BX, by the first initial compensation value. The second compensation value may be determined by multiplying a second gain RGAIN, which is determined according to the position of the main area BX, by the second initial compensation value.

According to the present exemplary embodiment, the driving controller 200 may determine whether the input image data IMG include a display quality deteriorating pattern such as a crosstalk pattern. The driving controller 200 may adjust the first compensation value applied to the left portion of the main area BX of the display quality deteriorating pattern and the second compensation value applied to the right portion of the main area BX, according to a position of the main area BX. Thus, the display quality deterioration may be minimized although the position of the main area BX of the display quality deteriorating pattern varies.

In addition, the driving controller 200 may adjust the first compensation value applied to the left portion of the main area BX of the display quality deteriorating pattern and the second compensation value applied to the right portion of the main area BX, according to a width of the main area BX. Thus, the display quality deterioration may be minimized although the width of the main area BX of the display quality deteriorating pattern varies.

Thus, display quality deterioration such as crosstalk may be prevented so that display quality of the display panel 100 may be enhanced.

As described above, in the display apparatus and the method of driving the display apparatus according to exemplary embodiments of the present inventive concept, the driving controller may determine whether the input image data include a display quality deteriorating pattern such as a crosstalk pattern. The driving controller may adjust a first compensation value applied to a left portion of a main area of the display quality deteriorating pattern and a second compensation value applied to a right portion of the main area, according to a position of the main area. Thus, the display quality deterioration may be minimized although the position of the main area of the display quality deteriorating pattern varies.

In addition, the driving controller may adjust the first compensation value applied to the left portion of the main area of the display quality deteriorating pattern and the second compensation value applied to the right portion of the main area, according to a width of the main area. Thus, the display quality deterioration may be minimized although the width of the main area of the display quality deteriorating pattern varies.

Thus, display quality deterioration such as crosstalk may be prevented so that the display quality of the display panel may be enhanced.

While the present inventive concept has been shown and described with reference to exemplary embodiments thereof, it will be apparent to those of ordinary skill in the art that various changes in form and details may be made thereto without departing from the spirit and scope of the present inventive concept as set forth by the following claims.

What is claimed is:

1. A display apparatus comprising:

a display panel configured to display an image based on input image data;

a driving controller configured to determine whether the input image data include a display quality deteriorating pattern, and to determine a first compensation value for compensating a first area disposed at a first side of a main area of the display quality deteriorating pattern and a second compensation value for compensating a second area disposed at a second side of the main area opposite to the first side of the main area, according to a position of the main area; and a data driver configured to apply a data voltage to the display panel using the first compensation value and the second compensation value, wherein the main area, the first area and the second area are determined based on grayscale values of the input image data, and wherein a size of the first area and a size of the second area is determined using a horizontal start point of the main area.

2. The display apparatus of claim 1, wherein when the size of the first area is greater than the size of the second area, the first compensation value is less than the second compensation value.

3. The display apparatus of claim 1, wherein initial compensation values corresponding to the first area and the second area are stored in a lookup table, wherein the first compensation value is determined by multiplying a first gain, which is determined according to the position of the main area, by the initial compensation value, and wherein the second compensation value is determined by multiplying a second gain, which is determined according to the position of the main area, by the initial compensation value.

4. The display apparatus of claim 3, wherein when the size of the first area is smaller than the size of the second area, the first gain is greater than one and the second gain is less than one.

5. The display apparatus of claim 1, wherein a first initial compensation value corresponding to the first area is stored in a first lookup table, and wherein a second initial compensation value corresponding to the second area is stored in a second lookup table.

6. The display apparatus of claim 5, wherein the first compensation value is determined by multiplying a first gain, which is determined according to the position of the main area, by the first initial compensation value, and wherein the second compensation value is determined by multiplying a second gain, which is determined according to the position of the main area, by the second initial compensation value.

7. The display apparatus of claim 1, wherein the driving controller is configured to store a first threshold grayscale value for determining the main area and a second threshold grayscale value for determining a background area except for the main area.

8. The display apparatus of claim 7, wherein when a grayscale value of the main area is greater than the first threshold grayscale value and a grayscale value of the background area is less than the second threshold grayscale value, the driving controller is configured to determine that the input image data include the display quality deteriorating pattern.

9. The display apparatus of claim 1, wherein when a difference between a first grayscale value corresponding to the main area and a second grayscale value corresponding to a background area except for the main area is greater than a threshold grayscale value difference, the driving controller is configured to determine that the input image data include the display quality deteriorating pattern.

10. The display apparatus of claim 1, wherein the driving controller is configured to determine the horizontal start point of the main area, a horizontal width of the main area, a vertical start point of the main area, and a vertical width of the main area.

11. The display apparatus of claim 10, wherein the driving controller is configured to determine the first compensation value and the second compensation value according to the horizontal width of the main area.

12. The display apparatus of claim 11, wherein when the horizontal width of the main area increases, the first compensation value and the second compensation value increase.

13. The display apparatus of claim 10, wherein the first compensation value and the second compensation value decrease from the vertical start point of the main area of the display quality deteriorating pattern to a vertical end point of the main area.

14. A method of driving a display apparatus, the method comprising:

determining whether input image data include a display quality deteriorating pattern;

determining a first compensation value for compensating a first area disposed at a first side of a main area of the display quality deteriorating pattern and a second compensation value for compensating a second area disposed at a second side of the main area opposite to the first side of the main area, according to a position of the main area; and applying a data voltage to a display panel using the first compensation value and the second compensation value, wherein the main area, the first area and the second area are determined based on grayscale values of the input image data, and wherein a size of the first area and a size of the second area is determined using a horizontal start point of the main area.

15. The method of claim 14, wherein when the size of the first area is greater than the size of the second area, the first compensation value is less than the second compensation value.

16. The method of claim 14, wherein initial compensation values corresponding to the first area and the second area are stored in a lookup table, wherein the first compensation value is determined by multiplying a first gain, which is determined according to the position of the main area, by the initial compensation value, and wherein the second compensation value is determined by multiplying a second gain, which is determined according to the position of the main area, by the initial compensation value.

17. The method of claim 16, wherein when the size of the first area is smaller than the size of the second area, the first gain is greater than one and the second gain is less than one.

18. The method of claim 14, wherein the display quality deteriorating pattern is determined using a first threshold grayscale value for determining the main area and a second threshold grayscale value for determining a background area except for the main area.

19. The method of claim 18, wherein when a grayscale value of the main area is greater than the first threshold grayscale value and a grayscale value of the background area is less than the second threshold grayscale value, the input image data are determined to include the display quality deteriorating pattern.

20. A method of driving a display apparatus, the method comprising:

determining that input image data includes a display quality deteriorating pattern including a main area and a background area except for the main area, using a first threshold grayscale value for determining the main area and a second threshold grayscale value for determining the background area;

determining a horizontal start point of the main area and a horizontal width of the main area;

determining a first compensation value for compensating a first area disposed at a first side of the main area and a second compensation value for compensating a second area disposed at a second side of the main area opposite to the first side of the main area, according to the horizontal start point of the main area and the horizontal width of the main area; and applying a data voltage to a display panel using the first compensation value and the second compensation value, wherein when the horizontal width of the main area increases, the first compensation value and the second compensation value increase, wherein a size of the first area and a size of the second area is determined using the horizontal start point of the main area, wherein when the size of the first area decreases, the size of the second area increases, and when the size of the first area increases, the size of the second area decreases, wherein when the size of the first area is less than the size of the second area, the first compensation value is greater than the second compensation value, and wherein when the size of the first area is greater than the size of the second area, the first compensation value is less than the second compensation value.

* * * * *